US009906862B2

(12) United States Patent
Heinrich et al.

(10) Patent No.: US 9,906,862 B2
(45) Date of Patent: Feb. 27, 2018

(54) STEREO MICROPHONE UNIT WITH TWO INTERFERENCE TUBES

(71) Applicant: Sennheiser electronic GmbH & Co. KG, Wedemark (DE)

(72) Inventors: Lars Heinrich, Hannover (DE); Lars Heine, Schwülper (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 15/301,855

(22) PCT Filed: Apr. 2, 2015

(86) PCT No.: PCT/EP2015/057363
§ 371 (c)(1),
(2) Date: Oct. 4, 2016

(87) PCT Pub. No.: WO2015/155126
PCT Pub. Date: Oct. 15, 2015

(65) Prior Publication Data

US 2017/0180860 A1 Jun. 22, 2017

(30) Foreign Application Priority Data

Apr. 7, 2014 (DE) ..... 10 2014 206 691

(51) Int. Cl.
*H04R 5/027* (2006.01)
*H04R 1/08* (2006.01)
*H04R 1/40* (2006.01)

(52) U.S. Cl.
CPC ..... *H04R 5/027* (2013.01); *H04R 1/086* (2013.01); *H04R 1/406* (2013.01); *H04R 2201/025* (2013.01); *H04R 2499/11* (2013.01)

(58) Field of Classification Search
None
See application file for complete search history.

(56) References Cited

U.S. PATENT DOCUMENTS 4,206,324 A * 6/1980 Horikawa ..... H04R 1/08 381/26
4,550,343 A * 10/1985 Nakatani ..... G11B 31/006 348/335

(Continued)

FOREIGN PATENT DOCUMENTS

DE 10 94 803 12/1960
DE 39 01 158 7/1990

(Continued)

OTHER PUBLICATIONS

International Search Report for Application No. PCT/EP2015/057363 dated Jun. 12, 2015.

(Continued)

*Primary Examiner* — Paul Huber
(74) *Attorney, Agent, or Firm* — Haug Partners LLP

(57) ABSTRACT

There is provided a stereo microphone unit having a first and a second interference tube which are arranged at an angle relative to each other and which respectively have a first end and a second end. The stereo microphone unit has a first and a second microphone capsule for detecting an audio signal. The microphone capsules are respectively provided at an end of the first and second interference tubes. The microphone unit further has a securing unit for jointly securing the first and second interference tubes, in particular to a mobile device or to a stand. There is also a cover as a wind protector which is connected to the securing unit and completely encloses the first and second interference tubes.

13 Claims, 5 Drawing Sheets

(56) References Cited

U.S. PATENT DOCUMENTS

| | | | | |
|---|---|---|---|---|
| 5,633,935 | A * | 5/1997 | Kanamori | H04R 3/005 381/26 |
| D719,140 | S * | 12/2014 | Sanhui | D14/225 |
| 2006/0239477 | A1 | 10/2006 | Oxford et al. | |
| 2010/0008511 | A1 * | 1/2010 | Kawano | H04R 5/027 381/26 |
| 2010/0135506 | A1 * | 6/2010 | Rosen | H01M 2/1055 381/91 |
| 2014/0270311 | A1 * | 9/2014 | Parker | H04R 1/08 381/361 |

FOREIGN PATENT DOCUMENTS

| | | |
|---|---|---|
| DE | 197 03 311 | 8/1998 |
| DE | 10 2007 021 395 | 11/2008 |

OTHER PUBLICATIONS

Brixen; E.B, "Microphones, High Wind and Rain in: Audio Engineering Society", Convention Paper 6624, 119th Convention, New York, Oct. 7-10, 2005.

Gerlach, H., "Stereo Sound Recording with Shotgun Microphones", In: J. Audio Eng. Soc., vol. 37, No. 10, Oct. 1989, pp. 832-838.

Wuttke, J., "Microphones and Wind", In: J. Audio Soc., vol. 40 No. 10, Oct. 4-8, 1991, pp. 809-817.

Wikipedia-Article "Microphone Windscreen", version of Nov. 3, 2014, last modified Mar. 7, 2016, https://de.wikipedia.org/w/index.php?title=Mikrofon-Windschut7&oldid-152258887.

Wikipedia-Article "Shotgun Microphone", version of Aug. 1, 2014, last modified Aug. 15, 2016, https://de.wikipedia.org/w/index.php?title=Richtrohmiikrofon&oldid=157040784.

* cited by examiner

STEREO MICROPHONE UNIT WITH TWO INTERFERENCE TUBES

The present application claims priority from International Patent Application No. PCT/EP2015/057363 filed on Apr. 2, 2015, which claims priority from German Patent Application No. 10 2014 206 691.3 filed on Apr. 7, 2014, the disclosures of which are incorporated herein by reference in their entirety.

FIELD OF THE INVENTION

It is noted that citation or identification of any document in this application is not an admission that such document is available as prior art to the present invention.

The present invention concerns a stereo microphone unit with two interference tubes and a camera unit.

An interference microphone, also referred to as a rifle microphone or a shotgun microphone, represents a microphone having an interference tube provided in front of a microphone capsule. The interference tube can be open at its two ends and has a plurality of side slots or bores. The provision of the slots and/or bores makes it possible to produce a directional effect, in particular in the range of medium and high frequencies of the interference microphone. In that respect the directional effect can be produced in particular by virtue of the fact that sound waves can be curved into the interference tube through the side slots or bores due to the design configuration of the interference tube.

DE 1094803 discloses a directional microphone having an interference tube with a plurality of longitudinal slots. The microphone capsule is provided at an end of the tube.

On the patent application from which priority is claimed the German Patent and Trade Mark Office searched the following documents:

DE 197 03 311 A1; US 2006/0 239 477 A1; BRIXEN; E. B.: Microphones, High Wind and Rain. In: Audio Engineering Society, Convention Paper 6624, 119th Convention, New York, 7.-10, Oct. 2005; GERLACH, H.: Stereo Sound Recording with Shotgun Microphones. In: J. Audio Eng. Soc., Vol. 37, No. 10, October 1989, pages 832-838; WUTTKE, J.: Microphones and Wind. In: J. Audio Soc., Vol. 40 No. 10, 4.-8, Oct. 1991, pages 809-817; Wikipedia-Article "Mikrofon-Windschutz", Version of 11, Mar. 2014; Wikipedia-Article "Richtrohrmikrofon", Version of 8, Jan. 2014.

SUMMARY OF THE INVENTION

The object of the present invention is to provide a microphone having a directional effect which permits improved sound detection.

Thus there is provided a stereo microphone unit with two interference tubes and two microphone capsules which are respectively provided at an end of the interference tubes. The two interference tubes are provided in a non-parallel arrangement. Optionally there is an angle between the first and second interference tubes, which is optionally less than 90 degrees. In addition the stereo microphone unit has a securing unit which can optionally be in the form of a common unit, by way of which both interference tubes can be secured jointly for example to a mobile device. The microphone unit has a first and a second interference tube or a first and a second directional tube which are arranged at an angle relative to each other. The angle between the first and second interference tubes determines the base width.

Optionally the angle between the first and second interference tubes can be adjustable. The microphone unit has a sound-permeable cover as a wind protector which (completely) surrounds at least the first and second interference tubes. The acoustic resistance of the cover can be so dimensioned that high frequency components are only very little attenuated. In addition the acoustic resistance is such that turbulence phenomena can be braked. The volume enclosed by the cover is such that that volume can serve as a calming zone in which turbulence can be calmed or reduced. By virtue of the fact that the first and second interference tubes or directional tubes are disposed in a cover the volume of the cover required can be reduced in comparison with two individual interference tubes without wind damping being worsened.

Optionally the microphone unit can have a securing unit for securing to a mobile device like for example a camera or to a stand. In that case the securing unit can be fixedly connected to the cover and optionally to the interference tubes so that the entire microphone unit enjoys good stability. The securing unit can optionally be in the form of a flash shoe adaptor.

The invention also concerns a camera unit having a camera and a stereo microphone unit with a first and a second interference tube which are arranged at an angle relative to each other and each have a first and a second end. A first and a second microphone capsule for detecting an audio signal is respectively provided at an end of the first and second interference tubes. Optionally the stereo unit can be fixedly secured to the camera unit.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
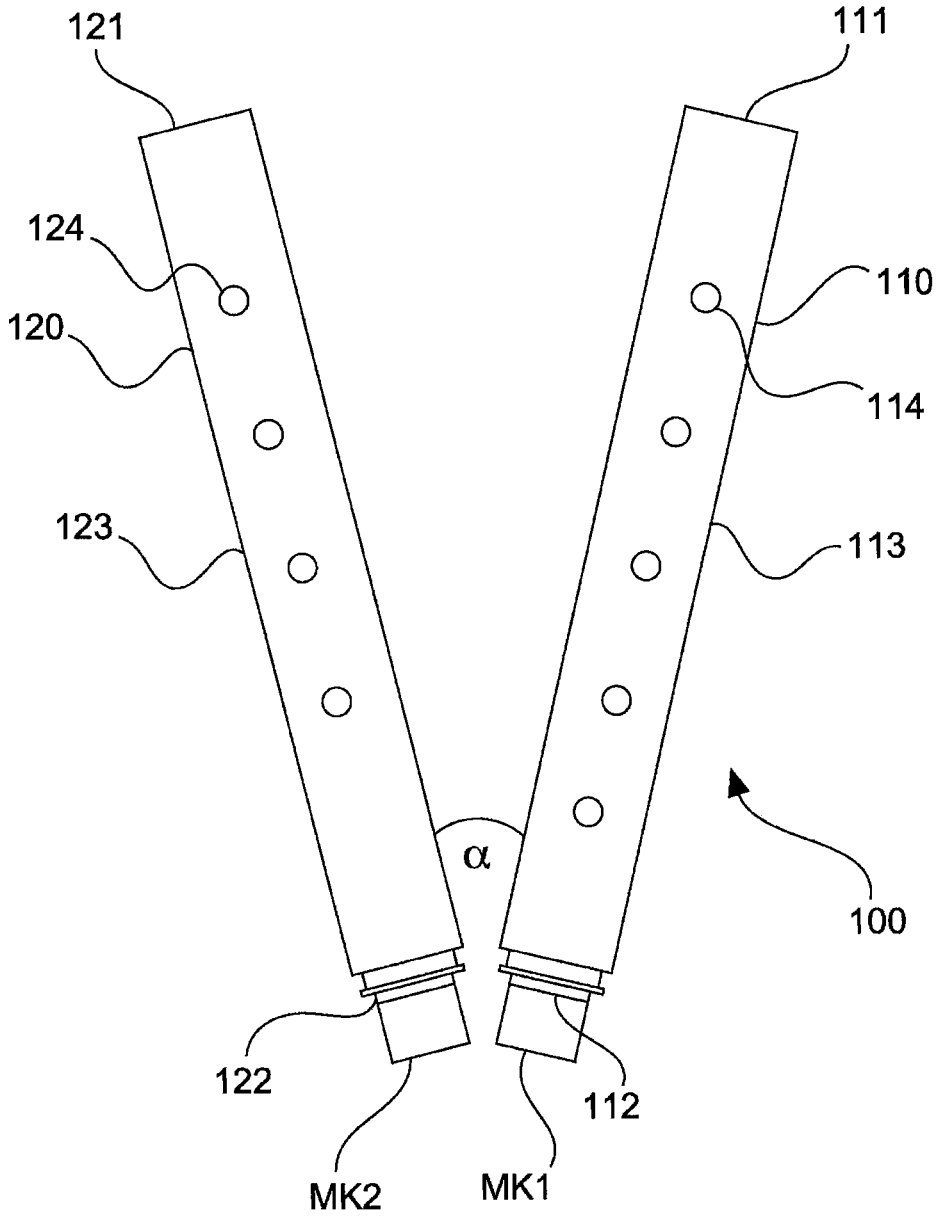
FIG. 1 shows a diagrammatic view of a microphone unit with two interference tubes according to a first embodiment.

FIG. 1 shows a diagrammatic view of a microphone unit having two interference tubes according to a first embodiment. The microphone unit 100 has two interference tubes or directional tubes 110, 120 arranged at an angle $\alpha$ relative to each other. The first and second interference tubes 110, 120 each have a first end 111, 121, a second end 112, 122, a peripheral surface 113, 123, and a plurality of bores or slots 114, 124. A first and a second microphone capsule MK1, MK2 is provided at the respective second ends 112, 122 of the first and second interference tubes 110, 120 to detect an audio signal. Only the interference tubes 110, 120 are shown in FIG. 1. The electrical connections to the interference tubes 110, 120 are not shown.

Figure 2:
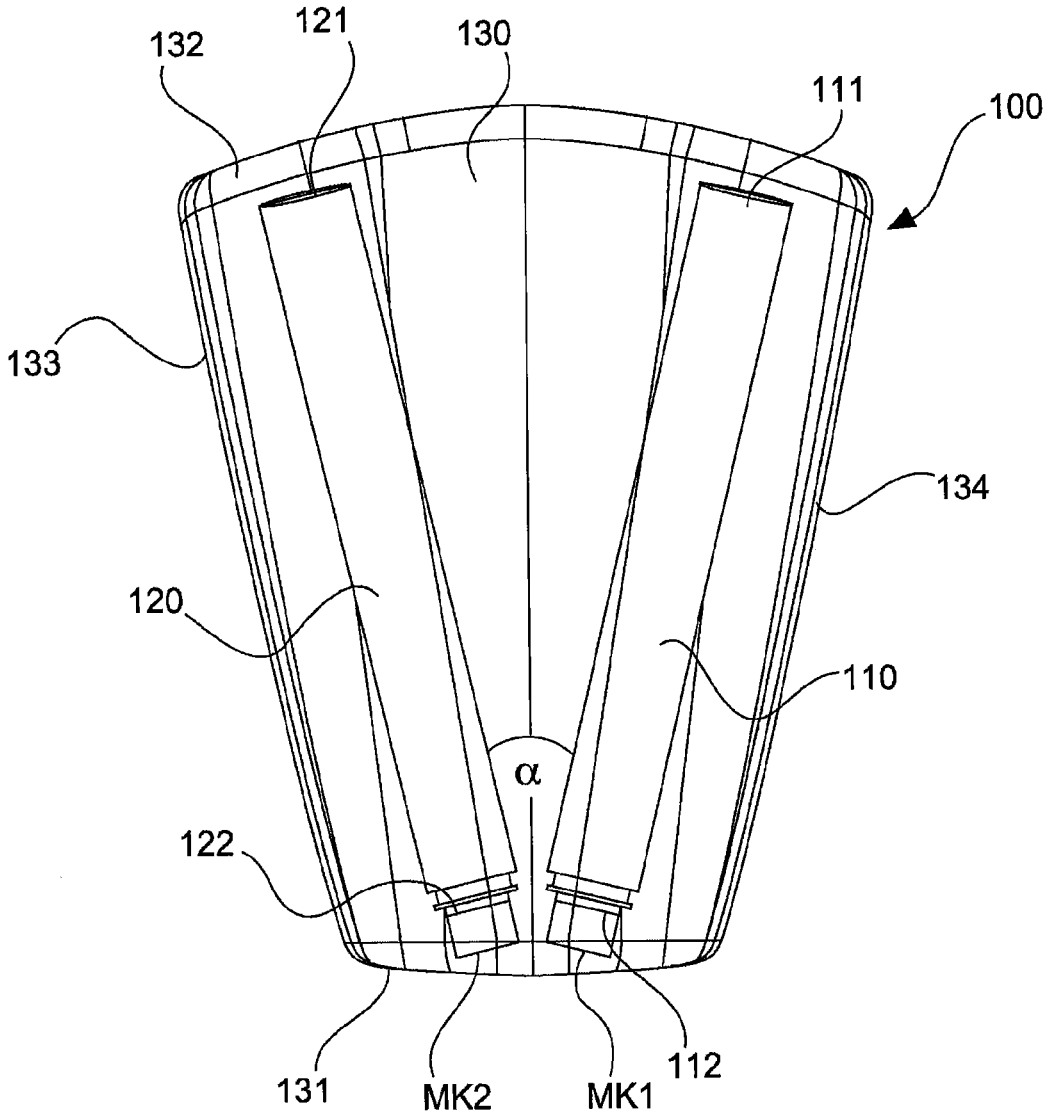
FIGS. 2 through 4 each show a diagrammatic view of a microphone unit according to a second embodiment.
Figure 3:
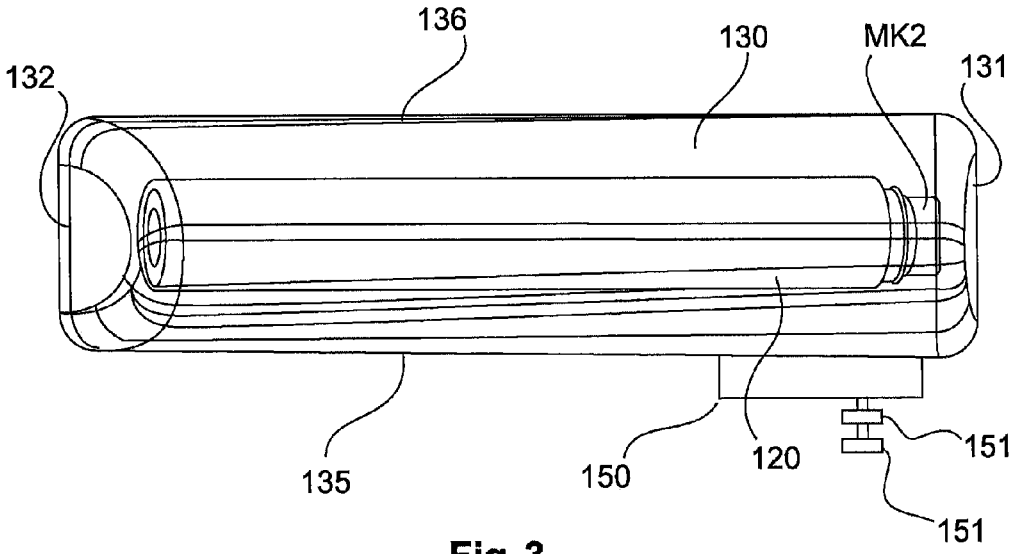
Figure 4:
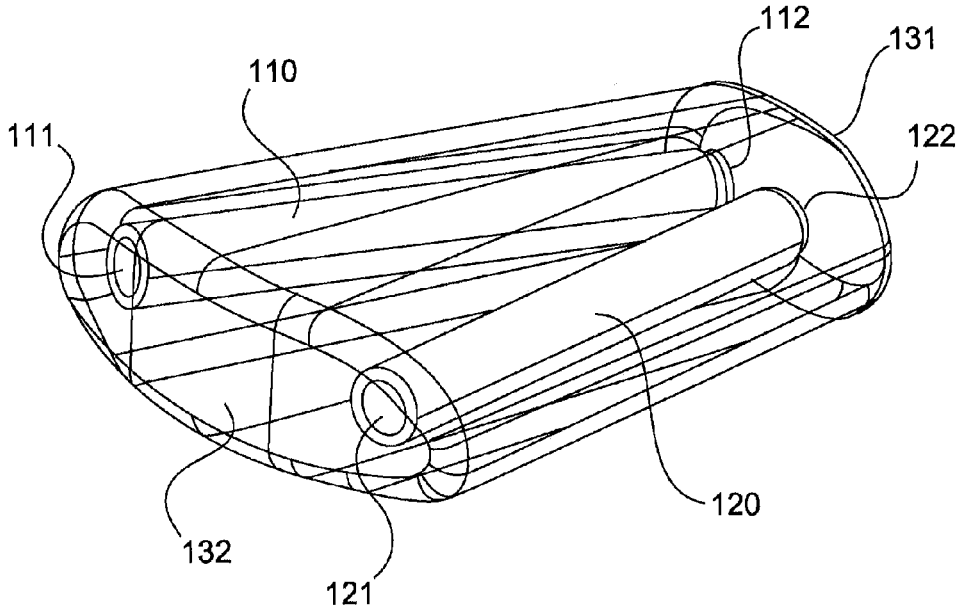

FIGS. 2 through 4 each show a diagrammatic view of a microphone unit according to a second embodiment. The microphone unit 100 according to the second embodiment can be based on the microphone unit 100 of the first embodiment. The microphone unit 100 thus has a first and a second interference tube 110, 120 each having a first end 111, 121, a second end 112, 122, a peripheral surface 113, 123 and a plurality of bores or slots 114, 124. There is an angle α between the first and second interference tubes 110, 120. A respective microphone capsule MK1, MK2 is provided at the second end 112, 122 of the first and second interference tubes 110, 120.

Provided around the first and second interference tubes 110, 120 is a cover 130 (as a wind protector) which completely encloses the first and second interference tubes 110, 120. The cover 130 has a first end 131, a second end 132, a first side surface 133 and a second side surface 134 as well as a top side 136 and an underside 135. The second end 132 is of a greater width than the first end 131, which is caused by the configuration of the first and second interference tubes 110, 120 and the angle α between them. The cover 130 has an acoustic resistance by which high frequency components are only little attenuated while nonetheless turbulence which can be produced for example by wind can be braked or damped. The volume of the cover 130 can be in the form of a calming zone so that turbulence can be calmed or reduced therein. The greater the volume of the cover 130 the correspondingly better or stronger is the damping of the interference noise generated by wind.

The provision of a single cover 130 (as the wind protector) for enclosing the first and second interference tubes 110, 120 can lead to a considerable space saving in respect of the cover 130 in comparison with a respective cover around each one of the interference tubes. That reduction in space of for example 50% does not have any adverse influence on the wind damping effect, in that case. What is decisive in terms of reducing wind noise is the size of the volume of the cover in which a shotgun microphone is disposed. The saving in volume is therefore afforded by virtue of a joint use of the volume of the cover for both interference tubes.

The cover 130 can thus be in the form of a wind protector for the microphone.

A base width can be determined by the angle at between the first and second interference tubes 110, 120. Optionally the angle between the first and second interference tubes can be adjustable.

Figure 5:
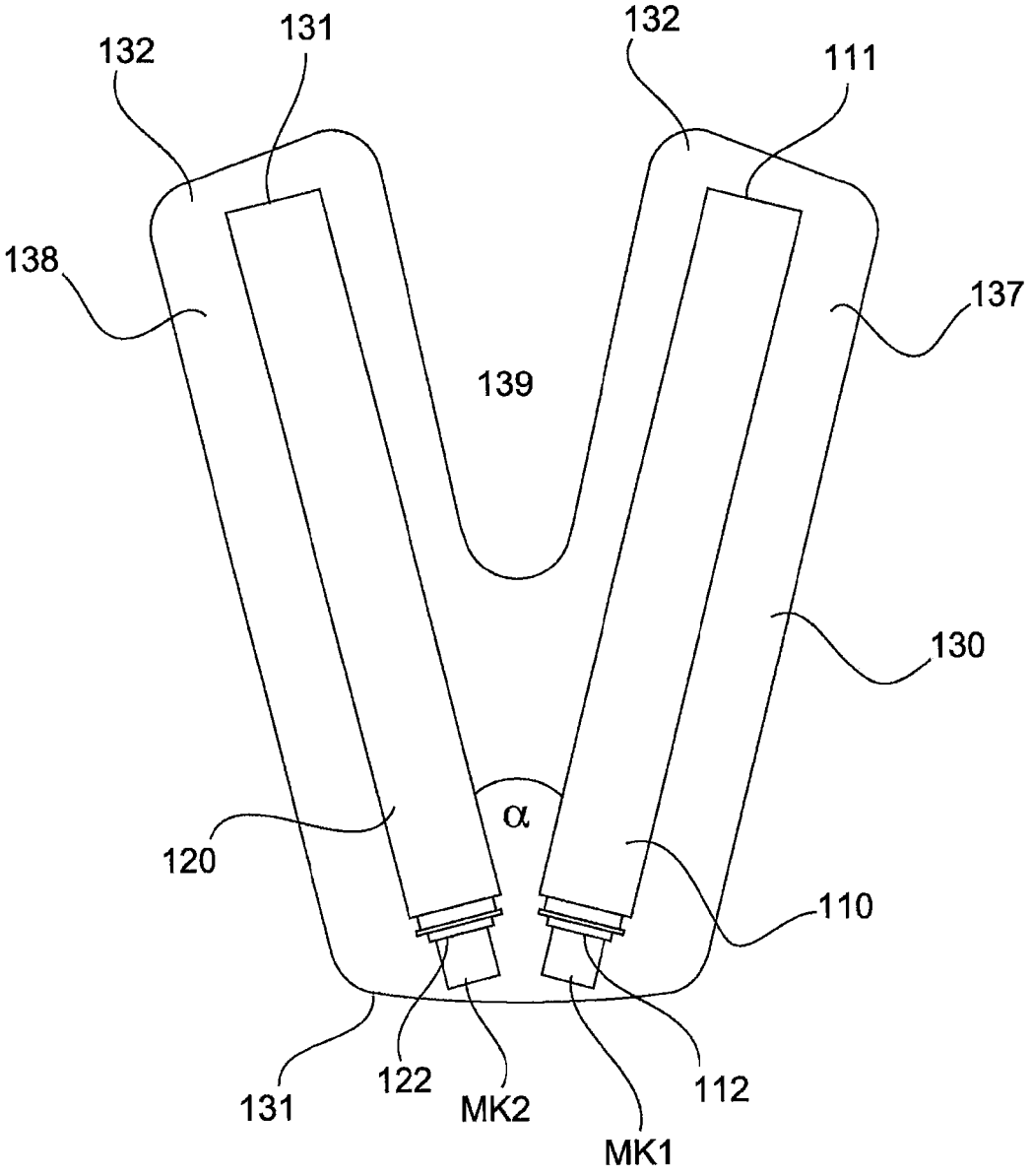
FIG. 5 shows a diagrammatic view of a microphone unit according to a third embodiment.

FIG. 5 shows a diagrammatic view of a microphone unit according to a third embodiment. The microphone unit 100 of the third embodiment can be based on a microphone unit according to the first or the second embodiment. In that respect the configuration of the first and second interference tubes 110, 120 corresponds to the configuration of the first and second interference tubes 110, 120 of the first or second embodiment. Provided around the two interference tubes 110, 120 is a cover 130 in which, in contrast to the cover of the second embodiment, a recess 139 is provided between the first ends 111, 121 of the first and second interference tubes 110, 120. By virtue of the provision of the recess 139 a first cover portion 137 encloses the first end 111 of the first interference tube and a second cover portion 138 encloses the first end 121 of the second interference tube 120.

The configuration of the cover according to the third embodiment means that the volume of the cover can be reduced without that having an adverse effect on the damping properties of the cover. That can be achieved in particular by the provision of a very small spacing between the interference tubes 110, 120 and the cover.

The microphone unit of the first, second or third embodiment also has a securing unit 150 which can be provided at the underside 135 of the cover and which is fixedly connected to the cover and/or the first and second interference tubes 110, 120 to be able to provide a stable microphone unit. That securing unit 150 can be secured for example to a flash shoe of a digital camera.

The microphone unit according to the invention is in particular adapted to be used with a mobile device like for example a digital camera, a camcorder or the like. The fact that there are two interference tubes 110, 120 and that a respective microphone capsule MK1, MK2 is provided at one of the ends of the interference tubes means that the microphone unit can be adapted to detect a stereo signal.

If the microphone unit is fixedly secured to a digital camera or a camcorder or another video camera and the second end of the cover is aligned with the optical axis of the camera then the microphone unit will always point in that direction in which the camera is directed and can then thus receive the audio signal from that direction.

Accordingly, the microphone unit can detect an audio signal which is coincident with an image portion of a film or video recorded with a camera. In addition it is possible in that way to provide that sound sources which are outside the image are recorded with a markedly lower level. In addition it is possible to record a stereo localization in relation to presentation of the video.

The microphone unit according to the invention can thus be in the form of a stereo microphone unit and can also be mounted to a mobile device like for example a digital camera, a camcorder, a video camera or the like. The design configuration of the two interference tubes or directional tubes means that stereo recordings can be effected at the same time as the camera records a video signal. It is thus possible to obtain a stereo audio signal which matches the movement of the mobile device, namely the camera.

According to an aspect of the present invention there is provided a microphone unit which can be fitted on to a camera and can detect a stereo signal by means of the two shotgun microphones. The microphone unit has a common securing unit for securing to or fitting on to the camera. Thus there is provided a microphone unit which can be fitted on to a camera and can detect a stereo signal without two individually secured shotgun microphones having to be provided in that case. By virtue of the connection of the stereo microphone unit to the camera a stereo audio signal can be recorded by the stereo microphone unit, and that signal produces a stereo signal matching the movement of the camera.

According to a further aspect of the present invention the two shotgun or interference tube microphones are enclosed by a common cover. The common cover serves for improved wind protection as more space is made available to the turbulence generated by the wind, in the enlarged volume of the cover, in order to calm such turbulence.

Figure 6:
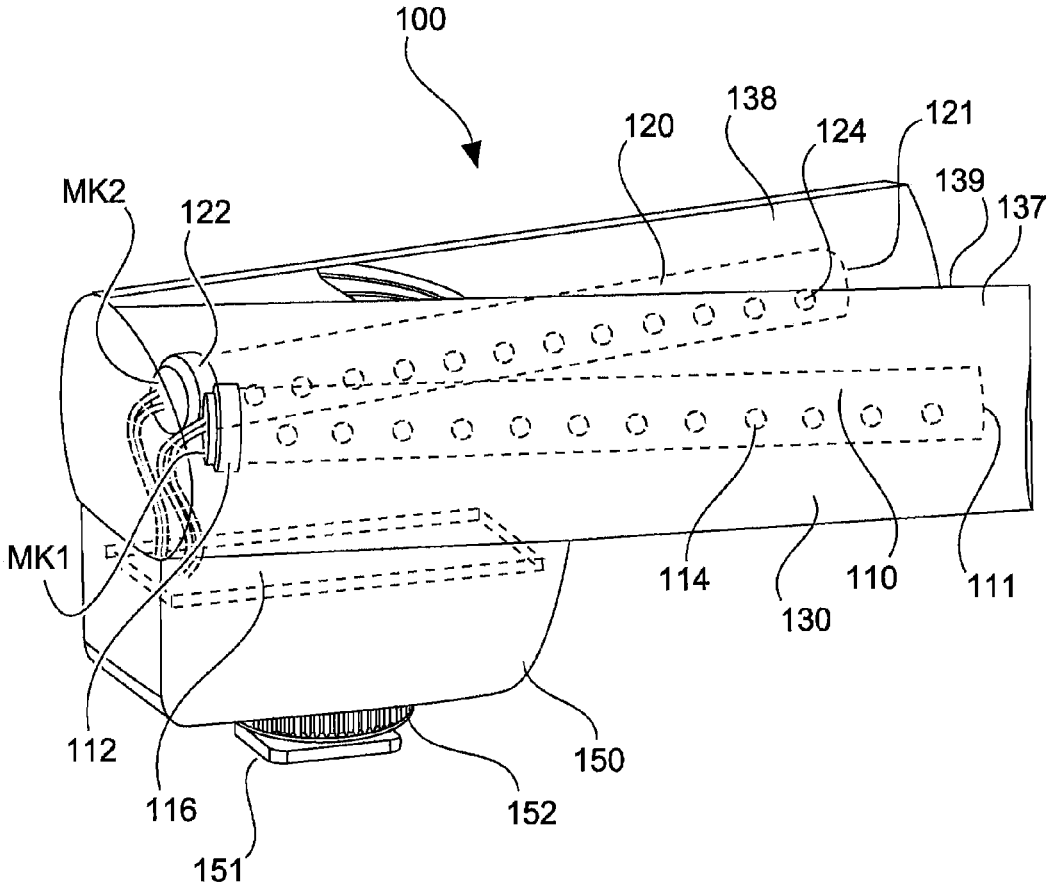
FIG. 6 shows a diagrammatic view of a microphone unit according to a fourth embodiment.

FIG. 6 shows a diagrammatic view of a microphone unit according to a fourth embodiment. The microphone unit 100 has a first and a second interference tube 110, 120. The interference tubes each have a first end 111, 121, a second end 112, 122 and a plurality of openings or holes 114, 124. Provided at the second ends 112, 122 of the first and second interference tubes 110, 120 is a respective microphone capsule MK1, MK2 which can be coupled to an audio processing unit 160 in which audio processing of the detected audio signals can take place.

The microphone unit has a cover 130 which can be of a V-shaped configuration and completely encloses the first and second interference tubes 110, 120. In addition the microphone unit 100 can have a securing unit 150. Optionally the securing unit 150 can represent a hot shoe adaptor 151 which has a knurled screw 152.

The microphone unit according to the invention can have a securing unit 150, preferably at the underside 135 of the cover 130. The securing unit 150 can optionally have a hot shoe adaptor 151 with a knurled screw 152. With that hot shoe adaptor 151 the microphone unit 100 can be secured for example on a camera, a video camera, a camcorder or the like.

As an alternative thereto the securing unit 150 can be adapted to secure the microphone unit to a stand.

According to an aspect of the present invention an audio processing unit 160 can be provided in the microphone unit, that receives the output signals of the microphone capsules MK1, MK2 and subjects same to audio processing. There can also be filters which subject the output signals of the microphone capsules MK1, MK2 to high-pass or low-pass filtering.

Optionally the microphone unit can have a power supply for example in the form of a battery or an accumulator.

According to a further aspect of the present invention the microphone unit can be in the form of a surround microphone unit which has at least two interference tubes or directional tubes and at least two microphone capsules. The surround microphone unit then also has a securing unit 150 and a corresponding cover 130. Optionally further microphone capsules can be provided in the microphone unit.

By virtue of the design configuration of the microphone unit with the at least two interference tubes and the angle $\alpha$ between those two interference tubes only the audio signals in front of the microphone unit are detected thereby. That is determined in particular by the directional characteristic of the microphone unit.

According to an aspect of the present invention the audio signals of the microphone capsules MK1, MK2 can be passed outwardly by way of a cable. Alternatively or in addition thereto it is possible to provide in the microphone unit a jack to which a corresponding cable can be connected.

The interference tubes according to the invention are in the form of tubes and have openings, bores or slots. The interference tubes according to the invention can also be produced from a gauze. What is important in that respect is that the interference tubes are not sealed.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A stereo microphone unit comprising:

a first interference tube and a second interference tube, which are arranged non-parallel relative to each other and respectively have a first end and a second end;

a first microphone capsule for detecting an audio signal, the first microphone capsule being provided at the second end of the first interference tube;

a second microphone capsule for detecting an audio signal, the second microphone capsule being provided at the second end of the second interference tube;

a wind protector comprising a cover that encloses the first and second interference tubes in an intercommunicating volume wherein the cover has a first end and a second end, the second end of the cover having a greater width than the first end of the cover; and a securing unit that is connected to the cover, and which is configured to jointly secure the first and second interference tubes to another object;

wherein the intercommunicating volume serves as a calming zone for calming turbulences for the first and second interference tubes.

2. The stereo microphone unit as set forth in claim 1;

wherein the angle between the first and second interference tubes is adjustable.

3. The stereo microphone unit as set forth in claim 2;

wherein the second end of each of the first and second interference tubes is provided in the region of the first end of the cover.

4. The stereo microphone unit as set forth in claim 3;

wherein the second end of the cover comprises:

a first cover portion that encloses the first end of the first interference tube;

a second cover portion that encloses the first end of the second interference tube; and a recess arranged in-between the first cover portion from the second cover portion.

5. The stereo microphone unit as set forth in claim 1;

wherein the securing unit is in the form of a hot shoe adaptor.

6. The stereo microphone unit as set forth in claim 1;

wherein an angle between the first and second interference tubes is less than 90°.

7. The stereo microphone unit as set forth in claim 3;

the wind cover further comprising a first side surface, a second side surface, a top side and an underside.

8. The stereo microphone unit as set forth in claim 3;

wherein a shape of the wind cover is configured to conform with the arrangement of the first and second interference tubes.

9. A camera unit comprising:

a camera; and a microphone unit as set forth in claim 1;

wherein the microphone unit is mounted to the camera by the securing unit.

10. A microphone unit comprising:

a plurality of interference tubes, where each interference tube of the plurality of interference tubes is arranged non-parallel relative to each other interference tube of the plurality of interference tubes, and wherein each interference tube respectively has a first end and a second end;

a plurality of microphone capsules, wherein a microphone capsule is provided at an end of each of the plurality of the interference tubes to detect an audio signal;

a wind protection cover that encloses the plurality of the interference tubes in an intercommunicating volume, wherein the cover has a first end and a second end, the second end of the cover having a greater width than the first end of the cover; and a securing unit that is connected to the wind protection cover, and which is configured to jointly secure the plurality of interference tubes to another object;

wherein the intercommunicating volume serves as a calming zone for calming turbulences for the plurality of the interference tubes.

11. A camera unit comprising:

a camera; and a microphone unit as set forth in claim 10;

wherein the microphone unit is mounted to the camera by the securing unit.

12. A camera unit comprising a camera; and a stereo microphone unit comprising:

a first interference tube and a second interference tube which are arranged non-parallel to each other and respectively have a first end and a second end;

a first microphone capsule for detecting an audio signal, the first microphone capsule being provided at the second end of the first interference tube;

a second microphone capsule for detecting an audio signal, the second microphone capsule being provided at the second end of the second interference tube; and a wind protector comprising a cover that encloses the first and second interference tubes in an intercommunicating volume, wherein the cover has a first end and a second end, the second end of the cover having a greater width than the first end of the cover;

wherein the intercommunicating volume serves as a calming zone for calming turbulences for the first and second interference tubes.

13. The camera unit according to claim 12, further comprising;

a securing unit that is connected to the cover, and which is configured to jointly secure the first and second interference tubes to another object.

* * * * *